United States Patent [19]

Frater

[11] 3,979,016

[45] Sept. 7, 1976

[54] SECURITY COVER FOR A CONTAINER

[75] Inventor: James J. Frater, Watertown, Wis.

[73] Assignee: Menasha Corporation, Neenah, Wis.

[22] Filed: Feb. 9, 1976

[21] Appl. No.: 656,819

[52] U.S. Cl. ..... 220/315; 220/356; 220/324; 220/334; 206/508; D9/219

[51] Int. Cl.[2] ..... B65D 43/08; B65D 45/16; B65D 21/00; B65D 45/00

[58] Field of Search ..... 220/324, 315, 352, 356, 220/380, 334, 340, 315; 206/503, 508, 509; D9/177, 219; D7/76; D87/1 R

[56] References Cited

UNITED STATES PATENTS

| | | | |
|---|---|---|---|
| 2,195,161 | 3/1940 | Baker | 220/340 |
| 3,376,046 | 4/1968 | Kivett et al. | 220/324 X |
| 3,759,415 | 9/1973 | Cloyd | 220/324 X |

*Primary Examiner*—William Price
*Assistant Examiner*—Steven M. Pollard
*Attorney, Agent, or Firm*—Andrus, Sceales, Starke & Sawall

[57] ABSTRACT

A container having a removable security cover. The container is formed with a peripheral rim which terminates in a downwardly extending flange. One end of the cover has a hook that terminates in an upwardly extending portion which is adapted to be positioned behind the flange of the container, while the opposite end of the cover is provided with a tab that is adapted to snap fit on the lower edge of the container flange. Registering holes in the cover and the rim of the container are adapted to receive a locking device. The peripheral portion of the cover has a generally rectangular ridge and when a second container is stacked on the cover the ridge prevents both lateral and longitudinal displacement of the upper stacked container.

13 Claims, 6 Drawing Figures

Fig. 1
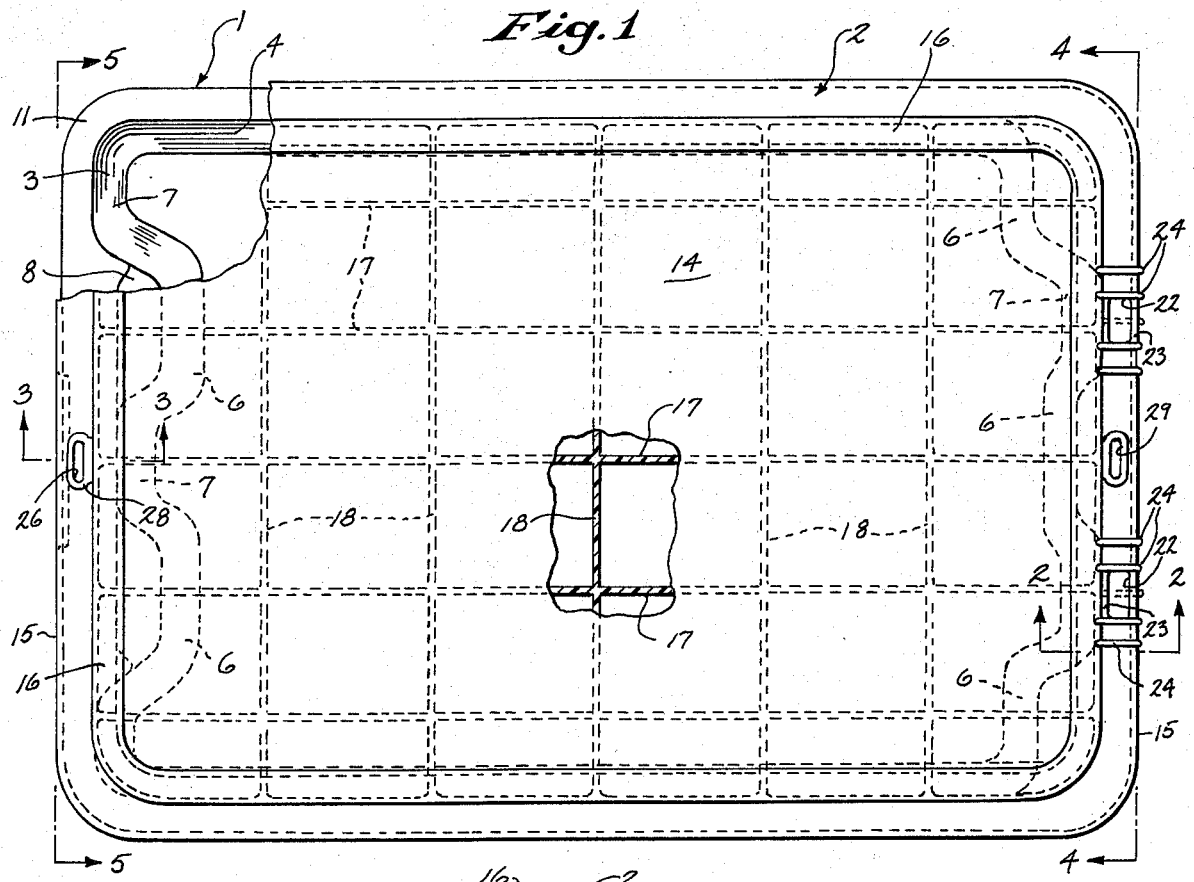
Fig. 2
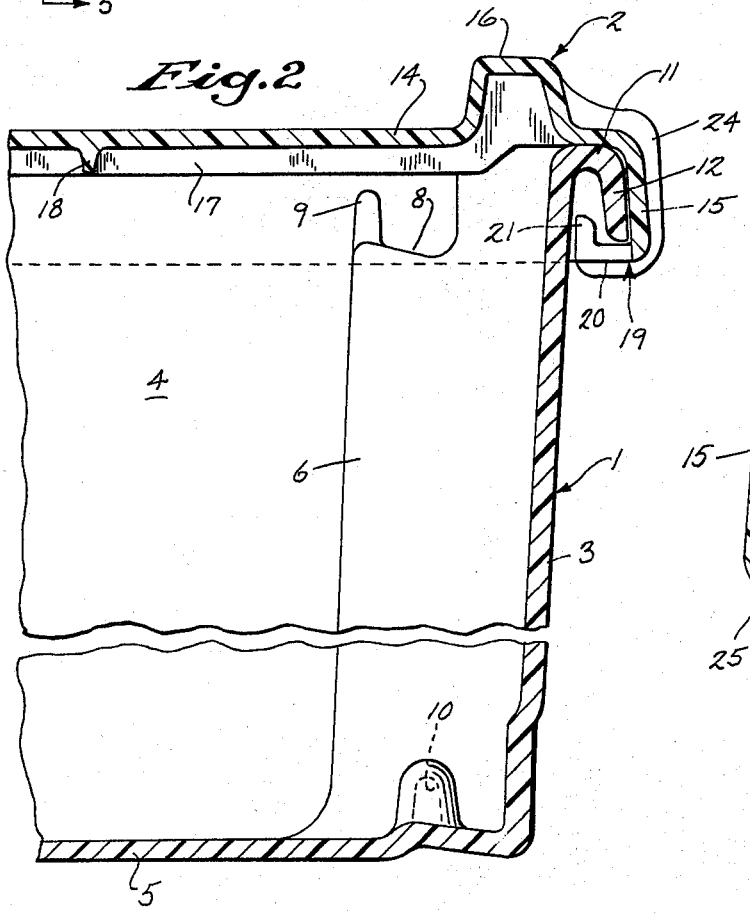
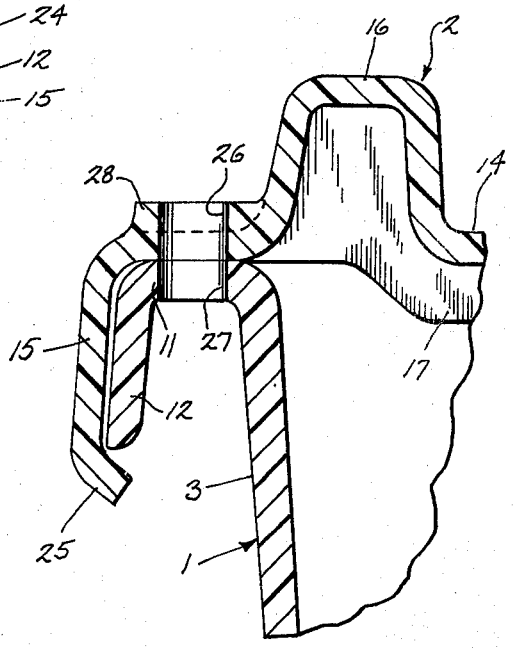
Fig. 3

SECURITY COVER FOR A CONTAINER

BACKGROUND OF THE INVENTION

Material handling containers are frequently provided with covers to enclose the contents of the container or to secure the contents against pilferage. When used merely to enclose the container, the cover commonly is provided with a peripheral flange which extends downwardly around the edge of the container. In many cases the cover is provided with dimples or recesses which are adapted to engage the rim of the container to prevent the cover from being displaced or dislodged from the container.

Security covers are used primarily during transporting or distributing materials out of the plant and are designed to prevent easy access to the contents and thus curtail pilferage. Should forced entry have occurred, it is readily evidenced by a damaged cover or container, or a broken locking device. Such tampering would be readily apparent when the transported goods are routinely checked at the various transfer points.

U.S. Pat. No. 3,379,341 discloses a security cover in which the cover is provided with a central depressed area and one end of the cover has a hook element which terminates in a horizontal edge that is received between horizontal ledges formed on the outer surface of one of the walls of the container, while the opposite end of the cover and the underlying portion of the rim of the container are formed with aligned holes to receive a locking device.

U.S. Pat. No. 3,360,162 also discloses a type of security cover in which an end of the cover is provided with an outwardly extending tongue that is inserted within a slot in the end wall of the container. The cover can be locked to the cover of the container by inserting a locking device through aligned holes in the opposite end of the cover and the rim of the container.

SUMMARY OF THE INVENTION

The invention relates to an improved security cover for a container. The container is formed with a peripheral rim which terminates in a downwardly extending flange. One end of the cover has a hook that terminates in an upwardly extending portion adapted to be positioned behind the flange of the container, while the opposite end of the cover is formed with a tab that is engaged by a snap fit with the lower edge of the container flange. To lock the cover to the container, aligned holes are formed in the container rim and in the portion of the cover that has the depending tab, and a locking device is adapted to be inserted through the aligned holes.

The peripheral portion of the cover is provided with an upstanding, generally rectangular ridge, and when a second container is stacked on the cover, the ridge will be located outward of the bottom of the upper stacked container to prevent both lateral and longitudinal displacement of the stacked container.

When the cover is locked to the container by use of a locking device, such as a padlock or cable ties, pilferage of the contents of the container is prevented, except through forced entry, and this will substantially aid in reducing thievery during transporting and distribution of the product. The engagement of the hook behind the flange of the container prevents removal of the cover by either prying the cover flange outwardly, or deforming the side wall inwardly. When the cover is unlocked, the hook provides a type of hinge connection for the cover to the container, so that the cover can be lifted to add or remove contents from the container without complete disengagement of the cover.

As the central portion of the container which supports an upper stacked container is not depressed, the cover does not reduce the usable volume of the container.

When containers are stacked, the upper stacked container will rest within the upstanding ridge on the cover of the lower container and any moisture draining downwardly along the sides of the upper stacked container from condensation or weather conditions will be retained within the area of the ridge on the lower container, and will not enter the lower container itself.

The cover construction can be adapted to any existing type container having a downwardly extending flange on the rim, and it is not necessary to reconstruct or modify existing containers in order to use the cover. This substantially simplifies tooling over prior art types of containers which have been specifically designed to receive covers and required more expensive side action molds to accommodate the cover construction.

Other objects and advantages will appear in the course of the following description.

DESCRIPTION OF THE DRAWINGS

The drawings illustrate the best mode presently contemplated of carrying out the invention.

In the drawings:

FIG. 1 is a top view of the cover construction of the invention as connected to a container, with parts broken away in section;

FIG. 2 is an enlarged fragmentary longitudinal section taken along line 2—2 of FIG. 1;

FIG. 3 is an enlarged fragmentary longitudinal section taken along line 3—3 of FIG. 1;

DESCRIPTION OF THE PREFERRED EMBODIMENT

Figure 4:
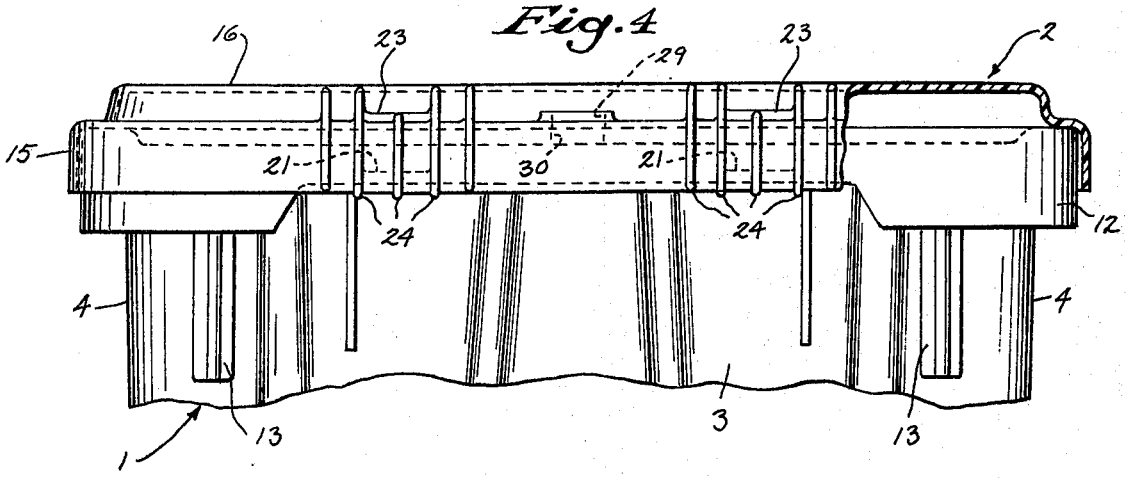
FIG. 4 is an end view taken along line 4—4 of FIG. 1, with parts broken away in section.
Figure 5:
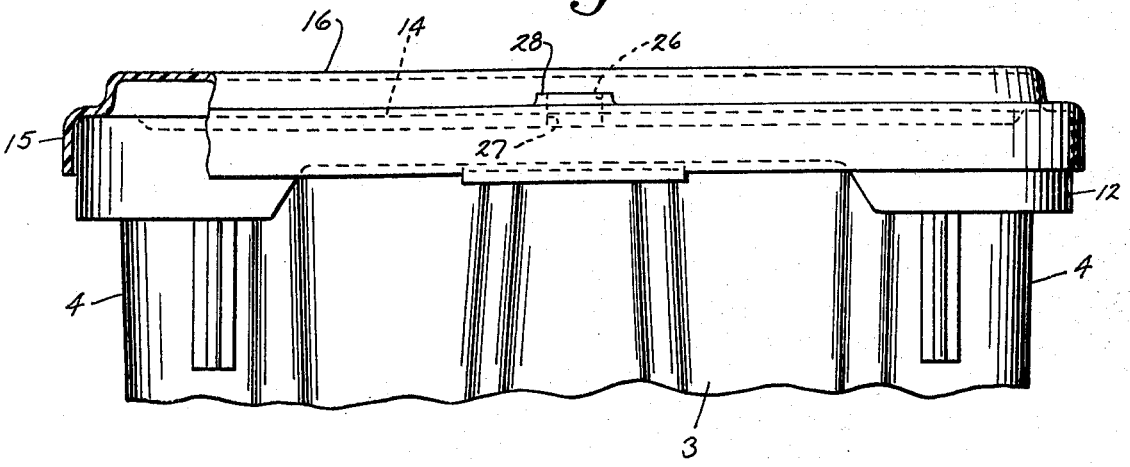
FIG. 5 is an end view taken along line 5—5 of FIG. 1 with parts broken away in section.

The drawings illustrate a container or tray 1, which is enclosed by a removable cover 2. The container can be formed of thermoplastic resin, fiber reinforced thermosetting resin, metal, or the like, and as illustrated in the drawings, the container is a typical stackable and nestable type in which two identical containers will nest together for storage when similarly oriented, and when the upper container is rotated 180°, it will stack vertically on the lower container.

The container 1 includes a pair of end walls 3 and a pair of side walls 4 which are connected together by a bottom wall 5. The end walls 3 are provided with alternate inwardly and outwardly extending convolutions 6 and 7 which are positioned so that an inwardly extending convolution 6 at one end of the container is located opposite an outwardly extending convolution 7 at the opposite end of the container. The end walls 3 and side walls 4 are sloped downwardly and inwardly to permit like containers to be nested together.

Downwardly and outwardly sloping shelves or ledges 8 are formed on the top of each of the inwardly extending convolutions 6 and the bottom surface of an upper stack container is adapted to rest on the shelf 8 when the containers are in the stacked position. Projections 9 extend upwardly from each of the shelves 8 and are received within recesses 10 formed in the bottom surface 5 of the upper stacked container to prevent displacement of the upper container when stacked.

The periphery of the container 1 is provided with a rim 11 which extends around the entire container and terminates in a downwardly extending vertical flange 12. A series of nesting stops 13 formed on the outer surfaces of the end walls 3 act to limit the insertion of an upper nested container into a lower container, to thereby prevent the containers from wedging together when nested.

The cover 2 includes a generally flat surface 14 which is adapted to rest on the rim 11 of the container, and the surface 14 terminates in a downwardly extending flange 15 that is located outwardly of the flange 12 of the container.

As shown in FIG. 1, a generally rectangular ridge 16 extends upwardly from the surface 14 and when a second container is stacked on the cover 2, the bottom surface 5 of the upper stacked container, as illustrated in FIG. 2, will be located within the ridge 16. The ridge thus prevents both lateral and longitudinal displacement of the upper stacked container.

To provide stiffening for the cover, a series of longitudinal ribs 17 extend downwardly from the surface 14 of the cover and cross ribs 18 are connected between the ribs 17.

In accordance with the invention, one end of the cover is provided with a pair of hooks 19. As best illustrated in FIG. 2, each of the hooks 19 includes a generally horizontal section 20 which extends inwardly from the lower end of the flange 15 and the horizontal section terminates in a vertical section 21 which is located inwardly of the flange 12 of the container.

To facilitate the molding of the hooks 19, the peripheral portion of the surface 14 is provided with holes 22 which are located in vertical alignment with the respective hooks and each hole 22 is bordered by reinforcing bead 23.

Figure 6:
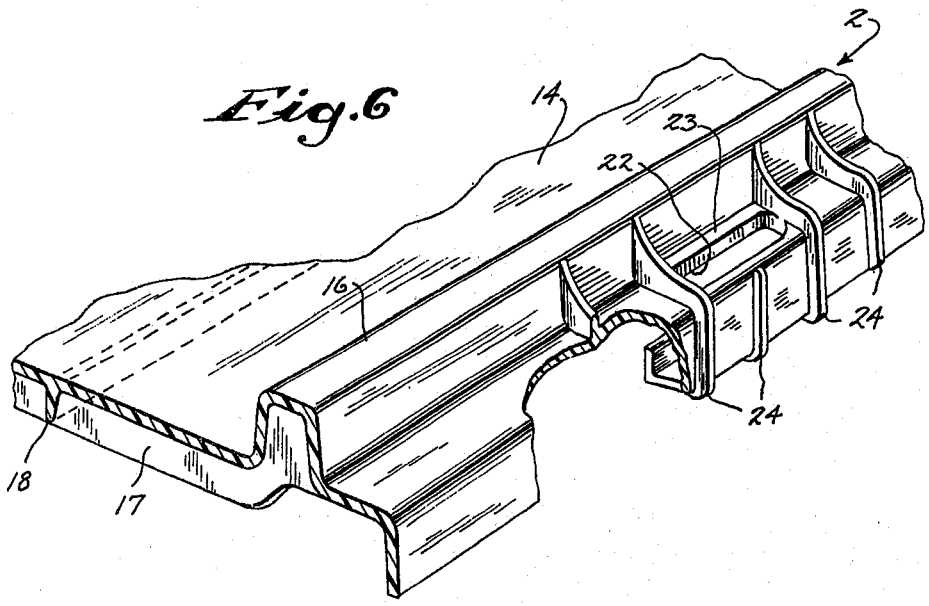
FIG. 6 is a partial perspective view showing a portion of the cover construction.

To stiffen the peripheral portion of the cover which has the hooks, a series of parallel ribs 24 are formed in the outer surface of the cover. As shown in FIGS. 2 and 6, the ribs 24 are attached to the outer surface of ridge 16 and extend over the surface 14, then downwardly along the flange 15 and inwardly beneath the horizontal section 20. The ribs 24 act to provide increased rigidity and stiffness for the area having the hooks 19 so that that portion of the container cannot readily be flexed or deformed to disengage the hook from beneath the flange 12 when the cover is locked in place.

The opposite end of the cover is provided with an inwardly extending edge or tab 25 which is adapted to be snap-fitted beneath the lower extremity of the flange 12 of the container. To install the cover, the hooks 19 are initially engaged behind the flange 20 and the cover is then pivoted downwardly and the tab 25 is engaged beneath the edge of the container flange, as shown in FIG. 3. Engagement of the hooks 19 and the tab 25 with the flange of the container will securely hold the cover to the container during handling and transporting.

To prevent removal of the cover from the container, registering holes 26 and 27 can be formed in the cover and the rim 11, respectively, and the hole 26 in the cover is bordered by a reinforcing rim or bead 28. A locking device, such as a pad-lock or cable lock, can be inserted through the aligned holes 26 and 27 to thereby prevent the cover from being removed from the container.

In some cases it may be desirable to also provide the end of the cover having the hooks 19 with a similar locking arrangement, and in this case the cover and the rim of the container can be provided with registering holes 29 and 30, similar to holes 26 and 27. The aligned holes 29 and 30 can also receive a suitable locking device, if desired.

Positioning of the hooks 19 behind the flange 12 of the container provides a hinge connection of the cover to the container which enables the cover to be lifted to add or remove contents from the container without completely dislodging the cover. The engagement of the hooks 19 and the tab 25 with the container flange acts to securely fasten the cover to the container so that it will not be dislodged during normal handling or transporting. Security against theft can be achieved by engaging a locking device with the registering holes 26 and 27 or 29 and 30.

The ridge 16 surrounds the bottom surface of an upper stacked container and not only acts to prevent displacement of the stacked container, but also serves as a sump to collect any moisture which may drip downwardly along the sides of the upper container, thereby preventing the moisture or other material from entering the lower container.

The cover can be utilized with containers of standard construction and it is not necessary to modify or alter the container construction in order to accommodate the cover. This substantially simplifies the tooling required in producing the container.

No specific end-to-end orientation of the cover with respect to the container is required and either end of the cover will fit with either end of the container.

Various modes of carrying out the invention are contemplated as being within the scope of the following claims particularly pointing out and distinctly claiming the subject matter which is regarded as the invention.

I claim:

1. A container assembly, comprising a container having a pair of opposed first walls and a pair of opposed second walls and a bottom wall connecting the first and second walls, said container also having a rim connected to the upper edges of the first and second walls and terminating in a downwardly extending flange, a cover to enclose the upper end of the container, said cover having a surface resting on said rim and having a downwardly extending flange located outwardly of the container flange, a hook member connected to the flange of the cover and terminating in an upwardly extending section disposed generally parallel to the flange on the cover and disposed inwardly of the flange of the container, and a tab connected to the flange of the cover and spaced from the hook member, said tab disposed in engagement with the lower edge of the flange on the container.

2. The container of claim 1, wherein the rim and the cover have aligned holes to receive a locking mechanism.

3. The container of claim 2, wherein the aligned holes are located adjacent said tab.

4. The container of claim 1, wherein said cover has a ridge extending upwardly from said surface, a second container adapted to be stacked on said surface and the bottom of said second stacked container being located inwardly of said ridge whereby said ridge prevents displacement of said second stacked container.

5. The container of claim 4, wherein said ridge is generally rectangular in configuration.

6. The container of claim 1, and including a plurality of reinforcing ribs on the outer surface of the flange of the cover adjacent said hook member.

7. A container assembly, comprising a container having a pair of opposed first walls and a pair of opposed second walls and a bottom wall connecting the lower edges of said first walls and said second walls, said container having a rim connected to the upper edges of said first and second walls and terminating in a downwardly extending flange, a cover to enclose the upper end of the container having a generally flat surface resting on said rim, said cover having a downwardly extending peripheral flange located outwardly of the flange on the container, a hook member connected to the periphery of the cover and including a generally horizontal section disposed beneath the lower edge of the container flange and an upwardly extending section connected to the horizontal section and located inwardly of said container flange, a tab connected to the periphery of the cover and located in spaced relation to said hook member, said tab being snap-fitted with the lower edge of the container flange, and upstanding means on said surface of the cover to prevent displacement of a second container stacked on the cover.

8. The container of claim 7, wherein said tab extends downwardly and inwardly from said periphery.

9. The container of claim 7, wherein said rim and said surface are provided with mating holes to receive a locking mechanism.

10. The container of claim 7, wherein said upstanding means comprises a generally rectangular ridge.

11. A security cover for a container, comprising a generally flat surface, a flange extending downwardly from the periphery of said surface, a hook member connected to said flange and including a generally horizontal section extending inwardly from the lower edge of said flange and an upwardly extending section extending upwardly from the inner end of said horizontal section and disposed in spaced generally parallel relation to said flange, said upwardly extending section adapted to be engaged behind a downwardly extending flange on a container, a tab connected to the lower edge of said flange and spaced a substantial distance from said hook member, said tab extending downwardly and inwardly and adapted to be snap-fitted on the lower edge of a container flange, and upstanding means extending upwardly from said surface and disposed to prevent lateral and longitudinal displacement of a second container stacked on said surface.

12. The cover of claim 11, wherein said upstanding means comprises a generally rectangular ridge.

13. The cover of claim 11, and including a plurality of reinforcing ribs on the outer surface of the flange of the cover adjacent said hook member.

* * * * *